United States Patent [19]

Wittman

[11] Patent Number: 4,715,259

[45] Date of Patent: Dec. 29, 1987

[54] STRAP MOUNTING ASSEMBLY FOR ELECTRIC GUITARS PERMITTING MULTIPLE GUITAR ROTATIONS

[76] Inventor: Kenneth L. Wittman, 416 Vine St., Montoursville, Pa. 17754

[21] Appl. No.: 34,446

[22] Filed: Apr. 6, 1987

[51] Int. Cl.[4] ..... G10G 5/00

[52] U.S. Cl. ..... 84/327; 224/910

[58] Field of Search ..... 84/327, 421; 224/910, 224/269, 271

[56] References Cited

U.S. PATENT DOCUMENTS

| | | | |
|---|---|---|---|
| Re. 31,722 | 11/1984 | Steinberger | 84/327 |
| 4,144,794 | 3/1979 | Silverman et al. | 84/327 |
| 4,343,217 | 8/1982 | Brody | 84/327 X |

*Primary Examiner*—L. T. Hix
*Assistant Examiner*—Brian W. Brown
*Attorney, Agent, or Firm*—Sughrue, Mion, Zinn, Macpeak & Seas

[57] ABSTRACT

A strap mounting assembly mounts to the rear face of a guitar body having an electrical pickup therein at a balance point permitting rotation of the guitar body about a horizontal axis at that balance point. The assembly includes a flat face plate having a tapped hole therein, a ring connector concentrically mounted about the tapped hole and insulated from the metal base plate. The flat base plate is screwed to the rear face of the guitar body with the ring connector facing outwardly. An elongated electrically insulated material molded arm has outboard and inboard ends, each including a hole therein along a longitudinal center line at right angles to the center line. A retainer button projects through one end of the strap, and is rotatably mounted within the first hole via a metal sleeve and is threaded into the base plate tapped hole. A screw passes through the second hole at the outboard end of the arm, and through the other end of the strap and is threadedly fixed to a retainer disk underlying that end of the strap. A shielded cable is integrally molded into the arm and the arm includes radially spaced, electrically insulated contacts having portions projecting outwardly from the arm. The contacts are formed of spring metal and engage respectively, the ring connector and the metal face plate to complete electrical connections to the base plate functioning as the ground and the ring connector as a "hot terminal" for connection to the output jack of the guitar body via a short length shielded cable.

7 Claims, 7 Drawing Figures

FIG. 1
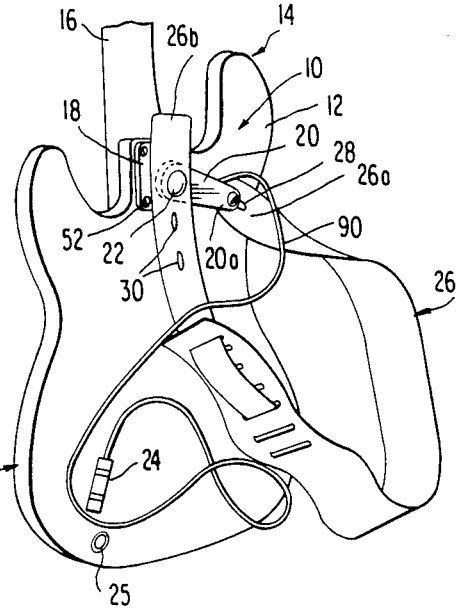
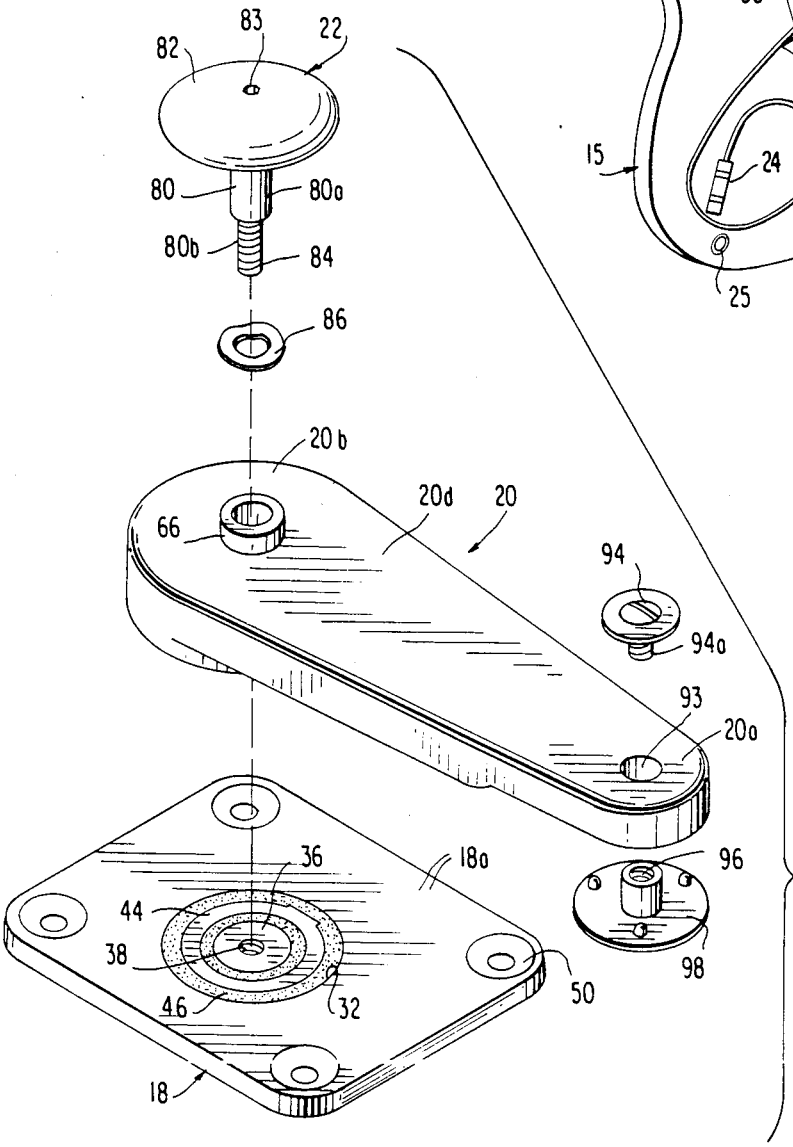
FIG. 2

FIG.3
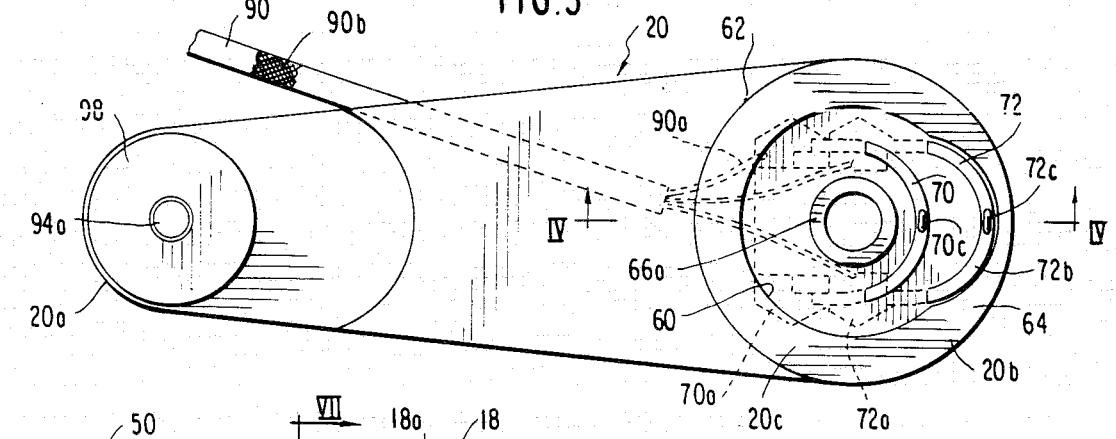
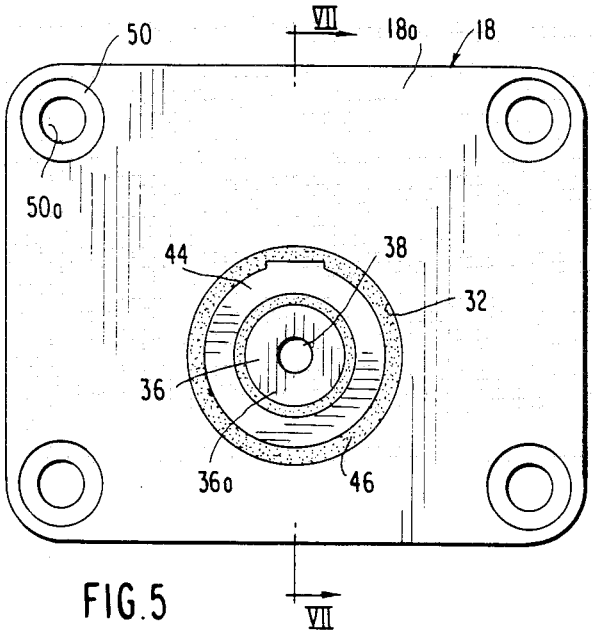
FIG.5
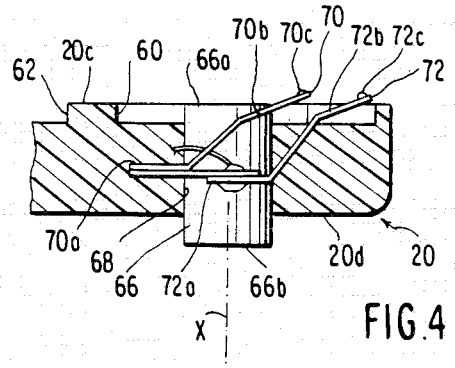
FIG.4
FIG.6
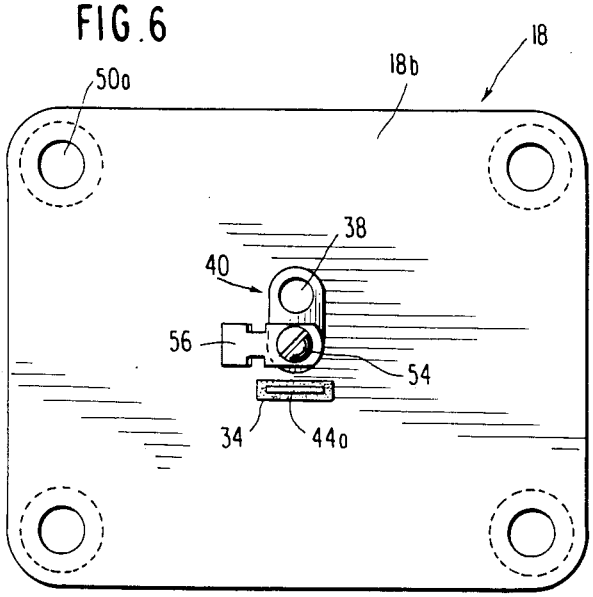
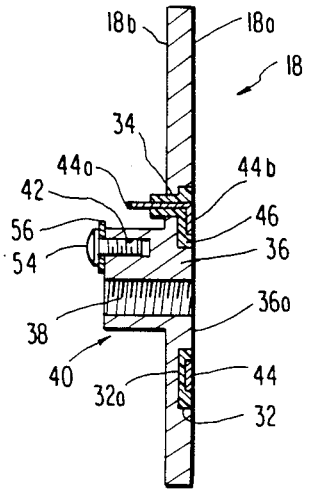
FIG.7

STRAP MOUNTING ASSEMBLY FOR ELECTRIC GUITARS PERMITTING MULTIPLE GUITAR ROTATIONS

FIELD OF THE INVENTION

This invention relates to an assembly for securing a strap to a musical instrument such as a guitar and more particularly, to such assembly that permits rotation of the guitar about a balanced pivot point while maintaining the electrical connection between the output of the guitar and the amplifier and sound system speakers.

BACKGROUND OF THE INVENTION

The electrically amplified guitar is a string musical instrument which is particularly used by rock and roll musicians. Such musicians play the instrument accompanied by wild gyrations, both of the performer and the instrument. Typically, the guitar is supported by a strap which attaches at opposite ends to the guitar at longitudinally spaced position with the strap extending over a shoulder of the performer. Adaptations have been made to pivotally couple the ends of the strap to the guitar so that the guitar may be rotated normally about a longitudinally axis over a relatively large number of rotations during the performance. At may be appreciated since the electronically amplified guitar has a sound pickup built into the guitar internally, electrical signals must be transmitted from the guitar to the amplifier, and then to the speakers.

No satisfactory light-weight harness or strap system has been devised which facilitates rotation of the guitar or like instrument about a given axis particularly where the string musical instrument is of the electrically amplified variety.

U.S. Pat. No. 4,144,794 is directed to a device for securing a harness or strap to a musical instrument such as a guitar, and which uses a pair of quick-release, spring loaded detachable connectors at opposite ends of the strap in the form of a male plug and a female receptacle. Receptacles are screwed onto opposite ends of the body of the instrument, and the male plugs fixed to the opposite ends of the straps. The male plug has a pin which carries spring biased ball detents for locking into an inner peripheral groove within the female receptacle axial bore which receives the pin of the male plug.

The problem is further complicated by the fact that the strap support system must be comfortable to the performer and must support the string musical instrument under conditions in which the instrument is balanced with the guitar maintaining a position permitting its play in front of the performer's body, supported by the strap system.

U.S. Pat. Re. No. 31,722 issued Nov. 6, 1984, and entitled "String Musical Instrument" stresses the need for a compact electric guitar or like instrument, the further necessity to provide a balanced musical instrument, and the need of providing boomerang support means located at the center of gravity of the instrument, and thereby achieve an instrument which is comfortable to play.

Where it is desired, as in the case of the present invention, that the electrical musical instrument, particularly an electrical amplified guitar, but not limited to, be rotated about a horizontal axis through the center of gravity of the instrument body, at the level of the waist of the performer, while strap supported, such arrangements in the past are excessively complicated and do not provide for the freedom of movement desired by the performer when enhancing the musical performance by periodic spinning of the electrically amplified instrument about that center of gravity.

U.S. Pat. No. 4,343,217 issued Aug. 10, 1982 and entitled "Dual Mode Guitar" is exemplary of a harness which consist of a pair of shoulder straps integrated to a waist strap or belt. The electrical guitar is characterized by two separate necks, two separate sets of strings, two separate electrical pick-ups and two separate sets of amplification controls. A rectangular plate like bearing assembly mounts to a socket within the belt, which socket is screwed onto the rear face of the guitar body. Electrical connections are formed by a male plug inserted into a female jack carried by the guitar body.

While the socket mounted bearing assembly approach of U.S. Pat. No. 4,343,217 is adequate where the guitar rotation is limited to 180° to change the mode of performance by shifting between two separate sets of strings, the system requires a special harness including two shoulder straps and a belt, is not seen as applicable to conventional strap systems, and maintenance of the electrical connection over multiple rotation of a guitar using such system appears unlikely.

It is therefor an object of the present invention to provide an improved, strap mounting assembly for a conventional strap applicable to the conventional electric guitars, and permitting multiple instrument rotation while electrical connection is ensured between the output jack within the instrument and the amplifier and other components of the sound system remote from the performer.

It is a further objective of the present invention to provide such strap mounting assembly for electric guitars and other instrument which permits multiple rotations, which is relatively simple, in which the strap attachments are made commonly to a single element of the mounting assembly, at opposite ends thereof, which permits unlimited rotation of the instrument body about a horizontal axis through the center of gravity of the instrument body, and wherein, an electrical lead emanating from that body may be readily attached to the single strap worn by the performer.

BRIEF DESCRIPTION OF THE DRAWINGS

FIG. 1 is a perspective view of a portion of an electric guitar carrying a strap mounting assembly forming a preferred embodiment of the present invention, with a single strap attached at opposite ends to the pivot arm of such strap mounting assembly.

FIG. 2 is a exploded, perspective view of the strap mounting assembly shown in FIG. 1.

FIG. 3 is a bottom plan view of the pivot arm forming a principal component of the assembly of FIGS. 1 and 2.

FIG. 4 is a vertical sectional view through a portion of the pivot arm of FIG. 3, taken about line IV—IV.

FIG. 5 is a top plan view of the base plate of the assembly of FIG. 1.

FIG. 6 is a bottom plan view of the base plate of FIG. 5.

FIG. 7 is a longitudinal sectional view through the base plate of FIG. 5, taken about line VII—VII.

DESCRIPTION OF THE PREFERRED EMBODIMENT

Referring to FIG. 1, the strap mounting assembly forming a preferred embodiment of the invention is illustrated generally at 10 and is shown as mounted to the rear face 12 of the electric guitar body indicated generally at 14, for guitar 15. The guitar is of classic form, it includes a neck 16 which radiates upwardly from body 14, and strings (not shown) are provided on the front face of the neck 16 which extend along the neck, and terminate near the end of the body 14 remote from the neck.

The strap mounting assembly 10 consists of three basic elements: a base plate 18, a pivot arm 20, and a retainer button 22. Integrally molded to the pivot arm 20 is a cable 90 which terminates in a suitable connector 24. The connector 24 may consistute an XRL connector having a locking feature although, a ¼ inch female jack may suffice for connector 24. A conventional guitar strap 26 suspends the guitar in front of the performer, the strap 26 having one end **26*a* detachably coupled to the outboard end 20*a* of the pivot arm 20 via a hole 28. The opposite end 26*b* of the strap 26 carries a series of holes 30, one of which, receives the threaded end of the retainer button 22 which end is screwed into base plate 18**.

Turning next to the exploded perspective view of FIG. 2 and the balance of the figures, it may be appreciated that base plate 18 is formed of cast metal and is rectangular in plan form. It has a front face **18*a* and a rear face 18*b*. Front face 18*a* is provided with an annular recess 32, the annular recess 32 extends partially through the thickness of the plate. Further, a rectangular slot 34 is formed within the plate, as an extension of recess 32 at its outer periphery. Further, the annular recess 32 defines a circular projection 36 which extends upwardly from bottom wall 32*a* of the recess, such that upper surface 36*a* of the cylindrical projection 36 is flush with the upper face 18*a* of plate 18. The plate 18 is provided with a tapped hole 38 which extends through the plate at projection 36 centered with the cylindrical projection 36. Integrally formed and extending outwardly from the bottom surface 18*b* of base plate 18, is an elongated, generally rectangular projection 40. A tapped hole 38 extends through the projection 40 at one end, while the opposite end carries a smaller diameter tapped hole 42 which extends into projection 40, but terminates short of front face 18*a*. The slot 34 is adjacent to the generally rectangular projection 40**.

A ring connector 44 formed of an electrically conductive metal such as copper, brass, or the like is mounted within the recess 36 by being embedded in a mass electrically insulative material 46. Ring connector 44 has an outer diameter which is less than the outer diameter of recess 32, and an inner diameter which is less than the outer diameter of the cylindrical projection 36. Further, the ring connector includes an integral, right angle bent tab **44*a* which extends downwardly through slot 34 and which tab protrudes outwardly from the bottom face 18*b* of base plate 18. The insulative material 46 which may be a suitable plastic, embeds the ring connector and fixes the connector 44 and its tab 44*a* to base plate 18, while insulating them from base plate 18**.

The base plate 18 is provided with four mounting holes 50 at its four corners, which holes are counter drilled at **50*a* to receive the tapered heads of mounting screws 52 employed in fixing the base plate 18 to the bottom face 12 of the guitar body 14, FIG. 1**.

In mounting the base plate 18 to the guitar body 12, it is necessary to drill or otherwise form a hole within the bottom 12 large enough to accommodate the projection 40 and the ring connector tab **44*a*. Tab 44*a* consitutes one solder terminal, in this case the "hot" lead terminal for attachment to a shielded cable (not shown) leading to an output jack (not shown) and conventionally incorporated within the guitar. Further, the smaller diameter tapped hole 42 receives the threaded end of screw 54, which passes through a hole within one end of a second solder terminal 56. Terminal 56 extends laterally outwardly from the projection 40 to which that solder terminal is mounted. Solder terminal 56 is to ground and thus is connected to the shield for the active lead. An active lead is soldered to the "hot" lead terminal defined by tab 44*a*. The shielded lead (not shown) extends to the output jack (not shown) of the guitar 15**.

Turning to the second major element of the assembly 10, the pivot arm 20 is of molded plastic, is elongated, and tapers from the inboard end **20*b* to the outboard end 20*a*. The ends are rounded. At the inboard end 20*b*, and within a lower face 20*c*, a circular recess 60 is provided within an enlarged diameter circular projection 62 of arm 20 defining an annular contact face 64, which rubs on the top face 18*a* of the base plate when the pivotable connection is completed between the pivot arm 20 and the base plate 18. Integrally molded into the pivot arm 20, coaxially with the circular projection 64, is a brass sleeve 66 having one end 66*a* projecting into recess 60 and another end 66*b*, projecting outwardly of the top face 20*d* of arm 20**.

As seen in the sectional view of FIG. 5, a first outer U-shaped spring metal wiper contact 72 is fixedly mounted to the brass sleeve 66 via the enlarged ends **72*a* of the U-shaped spring wiper contact, at a position intermediate of the ends of brass sleeve 66. Wiper contact 72 is connected to shield element 90*b* of cable 90. The middle of the first U-shaped wiper contact 72 is bent at an oblique angle to ends 72*a* and a center portion 72*b* thereof projects above the bottom surface 60*a* of recess 60. Center portion 72*b* includes an integral dimple 72*c*, which projects outwardly and makes surface contact with upper face 18*a* of metal base plate 18, and wipes on that surface 18*a* during rotation of pivot arm 20**.

Adjacent to the first wiper contact 72, in line therewith, and molded into the plastic pivot arm 20, is a second, U-shaped wiper contact 70, which is of similar configuration and is similarly sized to wiper contact 72. It is positioned next to the axis of the brass sleeve 66, and centered laterally on the pivot arm 20. The second wiper contact 70 includes a pair of enlarged ends **70*a*, at least one of which has a hole therein for making electrical connection to the "hot" lead 90*a* extending from the second wiper contact 70 to the output jack of the guitar. Further, in similar fashion to the first wiper contact 72, a center portion 70*b* of the second wiper contact is bent obliquely out of the plane of the enlarged ends 70*a* such that the center portion 70*b* projects outwardly from face of recess 60 and terminates above the plane of projection face 64. The second wiper contact 70 is provided with a outwardly projecting dimple 70*c*, at its center, which dimple 70*c* makes surface contact with the exposed surface 44*b* of ring connector 44 on the front face 18*a* of the base plate 18**.

The physical coupling of pivot arm 20 to base plate 18 is achieved by retainer button 22. Seen particularly in FIGS. 2 and 5, the retainer button comprises a threaded screw having a shank 80 including smooth surface shank portion **80*a*, integrated to a large head 82 having a semispherical upper surface. Head 82 carries an axial hole 83** of hexagonal configuration.

The shank 80 terminates in a reduced diameter portion **80*b* which is threaded at 84, which reduced diameter portion 80*b* is sized to the tapped hole 38 within base plate 18 and received therein. The length of the smooth surface portion 80*a* of the retainer button shank 80 is such that, with a spring washer 86 in place on the shank 80 and between the retainer button head 82 and the brass sleeve 66 of the pivot arm, the retainer button may have its threaded shank terminal end 80*b* threaded into the tapped hole 38 with the spring washer compressed to bias the contact dimples 70*c*, 72*c* of the first and second wiper contacts 70, 72 respectively against, face 44*b* of the ring connector 44 and the surface 18*a* of the base plate 18. Thus, a suitable mechanical coupling is effected between the rotating arm 20 and the base plate 18 fixed to the guitar body 14. Further electrical connections are maintained between the metal base plate 18 and the electrically insulated ring connector tab 44*a*, and the electrical lead 90*a* and shield element 90*b* of shielded cable 90 which is molded into the pivot arm, via respective first and second wiper contacts 70, 72, also molded into the pivot arm 20**.

Some mechanical resistance to rotation of arm 20 about the pivot axis X as defined by the brass sleeve 66 is effected by the spring washer which also acts somewhat like a lock washer to resist rotation of the retainer button relative to base plate 18, while allowing the brass sleeve 66 and pivot arm 20 to rotate about the sleeve axis.

The strap mounting assembly 10 is further characterized by the simplicity in mounting of the ends of the strap 26 to the guitar via assembly 10. In that respect, the outboard end **20*a* of the pivot arm 20, is provided with a hole 93 extending parallel to hole 68 carrying the brass sleeve 66. Projecting through hole 93 is a screw 94. The hole 93 within outboard end 90*a* of the pivot arm 90 of the pivot arm 20 is of a diameter larger than threaded shank 94*a* of screw 94. Threaded shank 94*a* is threaded into a tapped hole 96 within a strap retainer disk 98**.

End **26*a* of strap 26 is mounted to the outboard end 20*a* of the pivot arm by placing the threaded shank 94*a* of screw 94 through hole 28 within that end of strap 26, and screwing it into the retainer disk or plate 98. The opposite end 26*b* of the strap has one of its holes 30 positioned so as to receive the projecting end 66*b* of the brass sleeve 66 which projects above the top surface 20*d* of the pivot arm. The retainer button 22 is then screwed onto the base plate 18 and the end 26*b* of the strap is captured between the head 82 of the retainer button and the upper surface 20*d*** of the pivot arm.

It may be appreciated, the strap mounting assembly consists of a minimum number of parts which may be easily mounted to the guitar. The base plate 18 must be located at the balancing point, which may be readily achieved. The balancing point of the guitar or similar string instrument may be located by placing a round dowel, for example, a pencil on a flat surface, close to the edge, then laying the instrument on its back on the dowel with the dowel perpendicular to the neck. The instrument is rolled back and forth until it balances. The line extending through the contact point of the instrument with the dowel is marked and the instrument is rotated 90° so that the neck is parallel with the dowel, and the instrument is again rolled back and forth on the dowel until it balances. The second line is marked and where the two lines intersect this is the balancing point and should be the center point for mounting of the base plate to the back of the instrument. Preferably a ¾ inch round hole ½ inch deep is drilled into the back of the instrument to permit penetration of the projection 40 in the hole when the base plate is mounted to the back or rear surface 12 of the guitar body 14.

Prior to securing the base plate on the rear surface 12 of the guitar 15, it is necessary to make appropriate electrical connection to the sound output 25, FIG. 1, within the guitar body 14. This is achieved by making solder connections to the solder terminals **44*a*, 56 as seen in FIG. 6. The connection to the terminal 56 is to shield element of a small length of shielded cable, which must be connected in parallel with the output jack of the instrument. The other, insulated terminal defined by tab 44*a***, must be connected to the center conductor of that shielded cable.

Prior to making those connections, it is necessary to lay the base plate on the rear face 12 of the guitar body, so that the terminals **44*a*, 56 lie in the ¾ inch hole, with the hot terminal 46*a* closer to the bottom of the guitar body. The plate should lay in the same position as that of standard neck plate. After marking, four pilot holes should be drilled. In the exemplary mounting assembly disclosed, these holes may constitute four, pilot holes. After removal of the plate, it is necessary to drill a ¼ inch hole from the ¾ inch hole in the back 12 of the guitar body to the first pickup cavity. Through existing cavities, a small shielded cable may then be connected in parallel with the output jack of the instrument and the other end of the small shielded cable is then connected to the base plate terminals 44*a*, 56. After the electrical connections are made, the base plate 18 is secured to the back of the guitar body via four screws 52, FIG. 5**. In order to lubricate the area of rotation of the arm relative to the base plate, Vaseline or similar lubricant may be applied to the retainer button shank to help lubricate the part for smooth operation and to prevent corrosion of the contacts. Vaseline is acceptable, but no other lubricant should be used.

Assuming that the strap connections have been made to the pivot arm in the manner described previously, the performer places his right hand on the upper neck and places the left arm and head through the strap 26 with the pivot arm 20 pointing up. Under these conditions, the strap 26 will go over the performer's right shoulder and around his back, to the left, and connect at the retainer button 22. The instrument is connected to the amplifier by connection of the XRL connector 24 to the amplifier input (not shown), the lead 22 may be appropriately latched to the strap 26 at various points by VELCRO strips carried by the strap 26 (not shown).

It will be obvious that the numerous modifications and variations are possible with respect to the above described invention without materially departing from the scope of the invention. The foregoing description, in setting forth various constructional and operational details is for the purpose of understanding the device and its operations, and is not to be taken as limiting the scope of the present invention which is defined by the following claims.

What is claimed is:

1. A strap mounting assembly for mounting opposite ends of a strap borne by a performer to the rear face of an electrical string musical instrument body at a balance point thereof to permit the instrument body to be rotated about the axis of the balance point while maintaining electrical connections to said instrument body, said assembly comprising: a flat metal base plate having a tapped hole therein for placement coincident with said balance point and being screw mountable to said rear face, said flat base plate including a bottom surface mountable on the top surface of the rear face of said musical instrument body, and a top surface on the opposite side thereof, ring connector mounted to said base plate on said top surface and being electrically insulated from said base plate and having an integral "hot" terminal extending through said base plate and electrically insulated therefrom, an elongated arm formed of molded electrically insulative material having a longitudinal center line and having opposite inboard and outboard ends, a first hole within said inboard end of said arm at right angles to the longitudinal center line and intersecting said center line, a retainer button having a headed end and a threaded shank, said threaded shank projectable through one end of said strap and through said first hole within said inboard end of said arm and being threaded into said base plate tapped hole, said molded electrically insulative material arm having molded therein, radially spaced contacts about said first hole, an electrically shielded cable molded into said arm and having a shield element concentrically surrounding a core conductor and being electrically insulated therefrom, said shield element and said core conductor being electrically connected respectively to said molded, radially spaced contacts and wherein said radially spaced contacts are positioned with respect to said first hole such that portions project outwardly of the bottom surface of said arm and in contact respectively with said ring connector and the face of said metal base plate proximate to said arm whereby electrical circuits are completed between the shield element and conductor core of the shield cable molded into the arm and the metal base plate and ring connector respectively on the instrument body via respective radially spaced contacts to facilitate the connection between the base plate and ring connector and an electrical output jack, a screw projecting through a second hole within the outboard end of said elongated arm, said assembly further comprises a retainer disk having a tapped hole within the center thereof, and wherein, the end of the screw passing through said second hole and through the other end of said strap is threaded into said retainer disk and wherein, said strap is of the length between the ends thereof coupled to respective ends of said arm such that, the guitar may be rapidly rotated through multiple rotations about a point defined by the retainer button with the instrument positioned comfortably at the waist of the performer, while maintaining the electrical connection between a pickup and the shielded cable.

2. The strap mounting assembly as claimed in claim 1 wherein, a metal sleeve is fixedly molded into said arm first hole at said arm inboard end, wherein said retainer button has a headed end and a shank including, a smooth surface shank portion slightly smaller than the diameter of said sleeve and being rotatably mounted therein, and wherein said retainer button shank terminates in a threaded shank terminal end, threaded into said tapped hole of said base plate.

3. The strap mounting assembly as claimed in claim 2 wherein said molded, electrically insulative material arm comprises a circular projection at said inboard end, projecting outwardly from the bottom surface thereof, said circular projection includes a circular recess therein, concentric with said metal sleeve, said metal sleeve projecting for an end outwardly of said recess with a first end of said sleeve flush with the surface of said circular projection, and wherein, said radially spaced contacts molded into said arm, are formed of spring metal, and having a portion projecting outwardly of said molded arm recess, and projecting above a plane defined by said circular projection and said first end of said metal sleeve such that, threading of said retainer button into said base plate causes said radially spaced contacts to flex and to be biased into contact with said base plate ring connector and the face of said base plate about said ring connector respectively.

4. The strap mounting assembly as claimed in claim 3 wherein said first and second radially spaced contacts comprise U-shaped contacts having enlarged ends, one said contacts having respective ends fixed to opposite sides of the metal sleeve axially intermediate of the ends of said sleeve, and wherein, the centers of said U-shaped contacts project outwardly of the electrically insulative material arm, above the plane of the circular projection which makes rubbing contact with the outer surface of said metal base plate.

5. The strap mounting assembly as claimed in claim 4 wherein said U-shaped contacts each have an outwardly projecting dimple at the center thereof in contact with said ring connector and metal base plate, respectively.

6. The strap mounting assembly as claimed in claim 2 further comprising a spring washer concentrically mounted to said retainer button on said smooth surface portion of said shank and between the head of said retainer button and an end of said metal sleeve so as to bias the end of said circular projection on said inboard end of said arm into contact with said base plate and said radially spaced contacts into contact with the said base plate and said ring connector, respectively.

7. The strap mounting assembly as claimed in claim 6 wherein a recess is provided on the outboard end of said arm on the face proximate to said base plate, wherein said retainer disk has an axially raised portion facing said arm bearing said tapped hole wherein said screw passing through said second hole within said outboard end of said arm is of a length such that, when said screw is threaded to said retainer disk, a space is formed between said disk and the recessed surface portion of said outboard end of said arm and wherein the other end of said strap is captured between said retainer disk and the recessed face of said outboard end of said arm to permit relatively free rotation of said instrument body about the axis of the first hole within the inboard end of said arm without interference from the connection between the other end of said strap and said outboard end of said arm.

* * * * *